US005120157A

United States Patent [19]

Todd, Sr. et al.

[11] Patent Number: 5,120,157

[45] Date of Patent: Jun. 9, 1992

[54] TENNIS COURT IRRIGATION

[76] Inventors: George K. Todd, Sr., 2409 Ravine Dr.; George K. Todd, Jr., 300 Manatee Dr., both of Ruskin, Fla. 33570

[21] Appl. No.: 482,588

[22] Filed: Feb. 21, 1990

[51] Int. Cl.[5] ..... E02B 11/00; E02B 13/00

[52] U.S. Cl. ..... 405/36; 405/37; 405/38; 405/43; 405/51

[58] Field of Search ..... 405/36, 37, 38, 39, 405/43, 51

[56] References Cited

U.S. PATENT DOCUMENTS

| | | | |
|---|---|---|---|
| 1,665,104 | 4/1928 | Martienssen | 405/38 |
| 2,067,356 | 1/1937 | Swinhoe | 405/39 |
| 3,908,385 | 9/1975 | Daniel et al. | 405/37 |
| 4,188,154 | 2/1980 | Izatt | 405/43 |
| 4,462,184 | 1/1984 | Cunningham | 47/58 |
| 4,576,511 | 3/1986 | Vidal, Jr. | 405/37 |
| 4,832,526 | 5/1989 | Funkhouser, Jr. | 405/43 |
| 4,881,846 | 11/1989 | Burkstaller | 405/37 |
| 4,913,596 | 4/1990 | Lambert | 405/43 |
| 4,923,329 | 5/1990 | Sparfel | 405/36 |
| 4,948,294 | 8/1990 | Mercier | 405/37 |
| 5,059,064 | 10/1991 | Justice | 405/37 |

FOREIGN PATENT DOCUMENTS

| | | | |
|---|---|---|---|
| 1910641 | 9/1970 | Fed. Rep. of Germany | 405/36 |
| 1377328 | 2/1988 | U.S.S.R. | 405/36 |

*Primary Examiner*—Randolph A. Reese
*Assistant Examiner*—John A. Ricci
*Attorney, Agent, or Firm*—Lowe, Price, LeBlanc & Becker

[57] ABSTRACT

An underground system for supplying water to and removing water from an athletic facility having a surface which is susceptible to excessive moisture and dryness. The system includes an array of pipes which are positioned within rectangularly cross sectioned trenches having substantially level bottoms. Water is supplied to and removed from the array of pipes by a water control system at ambient pressures. The system may be installed into existing athletic facilities without excessive damage or disruption to their surfaces.

15 Claims, 3 Drawing Sheets

TENNIS COURT IRRIGATION

TECHNICAL FIELD

The present invention relates to the construction, watering and drainage of athletic facilities. In particular, the present invention relates to systems and methods for watering and draining the surfaces tennis courts and lawn bowling rinks.

BACKGROUND ART

Systems located underground for supplying water to the surface or subsurface of a defined area are well known and take many forms. Such systems are utilized not only in agricultural environments for the irrigation of crops, but also in the sports and recreational fields. Such applications include underground watering systems for football and baseball fields, golf courses and in applications of hard, natural surfaced athletic facilities such as tennis courts and lawn bowling rinks which employ clay or other fast-drying playing surfaces.

Hard lawn tennis courts such as are made with sand, ashes, rubble, brick dust, clay, or the like suffer from the drawback that the upper surface layer dries very quickly and becomes too dusty. As a consequence of becoming dry and dusty, the surface becomes subjected to rapid wear so that frequent repair of the upper layer is necessary, involving considerable expense. To prevent the formation or rising of dust and subsequent surface wear and deterioration, it has, in the past, been the common practice to moisten the surface by sprinkling the surface with water.

The development of underground systems for supplying water to athletic facilities has eliminated the need for manually watering the surfaces of hard surface athletic facilities such as clay tennis courts. However, system; which have been developed heretofore have certain disadvantages in that they tend to be over-complicated and cannot be easily installed into existing athletic facilities without major disruptions to the facility. Additionally, such systems generally incorporate liners which tend to retain water, and thus cause over-watering during rain.

U.S. Pat. No. 1,665,104 to Martienssen discloses a drainage system for tennis courts which includes a plurality of inclined drain pipes located in a layer of drainage material which is intermediate a lower impermeable layer and an upper plain surface. This system is particularly designed for drainage of the playing field.

U S. Pat. No. 2,067,356 to Swinhoe discloses a court for games which includes a plurality of parallel pipes which are connected to a water supply pipe. The pipes are located in a compartmented sub-surface layer of the playing field and are covered with a layer of broken stones and an additional layer of ashes. Excess water is drained from the field by means of gaps formed in a brick boundary which surrounds the playing field.

U.S. Pat. No. 4,576,511 to Vidal discloses an apparatus and method for creating and controlling an artificial water table. The system of Vidal includes a reservoir which controls the depth of the artificial water table. Water in the reservoir is allowed to pass through a ballast layer beneath an athletic or agricultural field and pass upwardly through a permeable membrane and into a layer of fine material by capillary action. The depth of water is controlled in the reservoir by means of a water level control float and a drain which is connected to a pump which is operated by an additional float.

U.S. Pat. No. 4,832,526 to Funkhouser discloses an underground watering system for athletic facilities which includes a plurality of trenches having curved bottom surfaces with a waterproof liner located in each of the trenches. An inclined perforated pipe is located in each trench and serves to supply water to the trenches. A course material surrounds the perforated pipes and is covered by a permeable fabric material which in turn is covered by two intermediate stone aggregate layers.

Generally, prior art underground watering systems must be installed prior to the construction of the athletic field surface area. The present invention is an improvement over the prior art and provides for a system which may be easily incorporated into existing tennis courts, lawn bowling rinks, and the like, and which may be utilized to both water and drain water from such sports facilities.

DISCLOSURE OF THE INVENTION

It is accordingly, one object of the present invention to provide an underground watering and draining system for supplying water to and removing water from the surface of a defined area.

It is another object of the present invention to provide an underground watering and draining system for athletic facilities.

It is yet another object of the present invention to provide an underground watering and draining system which can be installed into existing athletic facilities without major disruption of the surface thereof.

A still further object of the present invention is to provide for an underground watering and draining system which includes a simplified control system for supplying and removing water therefrom.

A still further object of the present invention is to provide an underground watering and draining system which passively supplies and removes water from the system.

A still further object of the present invention is to provide a water control system which can be used for supplying water to and removing water from an underground watering system of an athletic field.

A still further object of the present invention is to provide a method for installing underground watering and draining systems into athletic facilities.

According to the present invention there is provided an underground system for supplying and removing moisture to and from a surface of an athletic facility which surface comprises a material which is susceptible to excessive moisture and dryness comprising:

a pair of rectangularly cross sectioned trenches having substantially level bottoms, the pair of trenches being parallel to one another;

a plurality of rectangularly cross sectioned trenches having substantially level bottoms, the trenches being relatively equally spaced apart from and aligned parallel to one another and extending at opposite ends thereof between the pair of trenches;

means located within and on the bottoms of each of the trenches for supplying moisture to and removing moisture from the trenches;

a sublayer of a material through which moisture may pass by capillary action located in each of the trenches, above the means for supplying and removing moisture;

a surface layer of the material which is susceptible to excessive moisture and dryness; and a water control system for supplying and removing, under ambient pressures, water from the means for supplying and removing moisture.

Also provided by the present invention is a method for installing an underground system for supplying and removing moisture from a surface of an athletic facility which comprises providing a pair of rectangularly cross sectioned trenches having substantially level bottoms in the surface of the athletic facility, the pair of trenches being parallel to one another;

providing a plurality of rectangularly cross sectioned trenches having substantially level bottoms in the surface of the athletic facility, the trenches being relatively equally spaced apart from and aligned parallel to one another and extending at opposite ends thereof between the pair of trenches;

positioning means on the bottoms of each of the trenches for supplying and removing moisture from the trenches;

filling in the trenches with a sublayer of a material through which moisture may pass by capillary action above the means for supplying and removing moisture;

covering each of the trenches with a surface layer of the material which is susceptible to excessive moisture and dryness; and connecting the means for supplying and removing moisture to and from the trenches to a water control system for supplying and removing, under ambient pressures, water to and from the means for supplying and removing moisture.

The present invention further provides for an improved underground system for supplying water to and removing water from a defined area by means of an arrangement of distribution pipes positioned underground, the improvement comprising a water control system for supplying and removing, under ambient pressures, water from the arrangement of distribution pipes, the water control system being positioned below ground level and comprising a reservoir including a water supply pipe, a water outlet pipe which is in fluid communication with the arrangement of distribution pipes, and a drain pipe.

BRIEF DESCRIPTION OF THE DRAWINGS

The present invention will now be described with reference to the annexed drawings, which are given by way of non-limiting examples only in which.

BEST MODE FOR CARRYING OUT THE INVENTION

Figure 1:
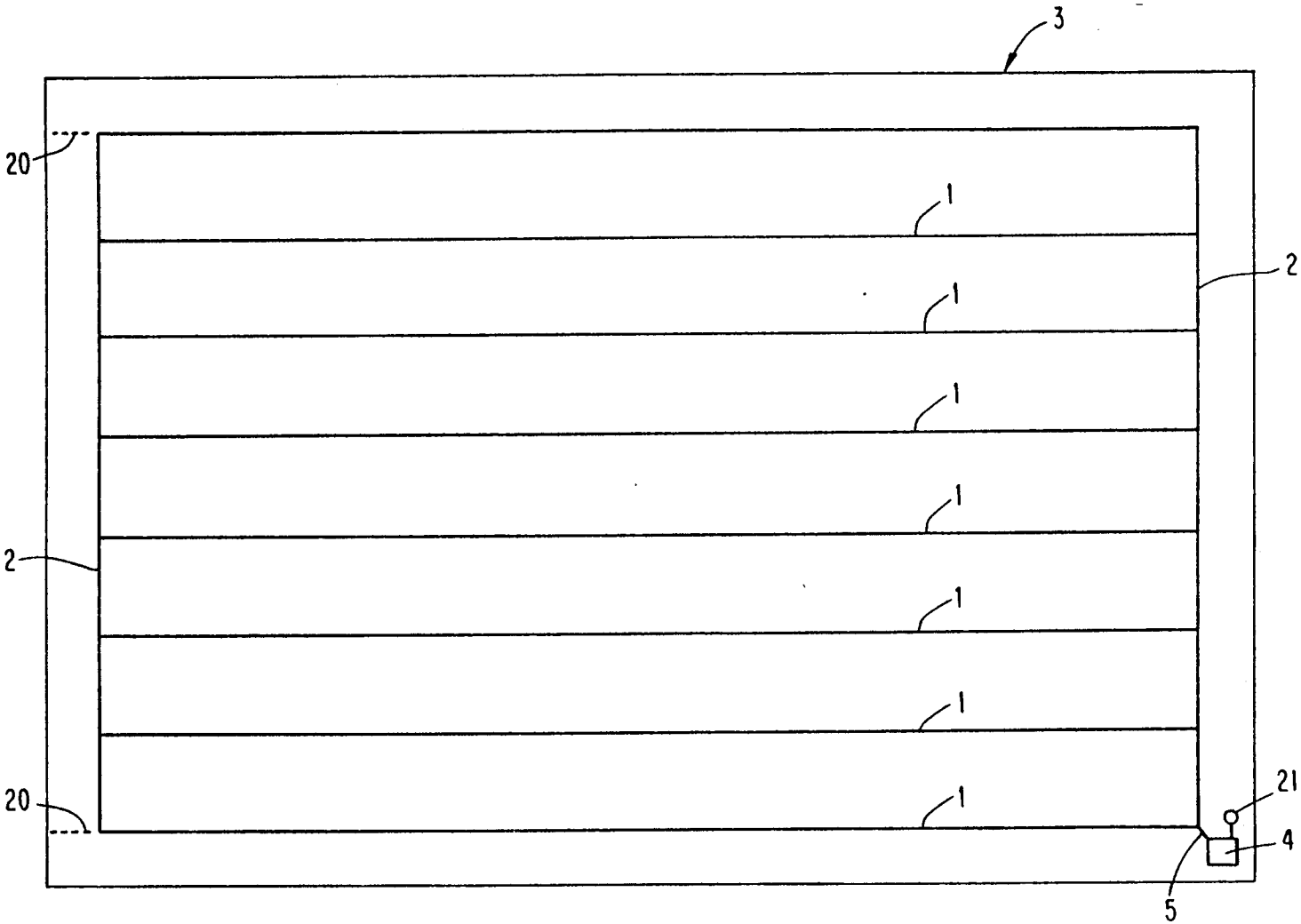
FIG. 1 is a schematic planar representation of the base of an athletic facility illustrating the arrangement of the plurality of parallel pipes including water distribution means in accordance with one preferred embodiment of the present invention.

The present invention is directed to an underground watering and draining system which can be used to supply and remove water to and from any type of land area, but which is particularly advantageous for use in hard, natural surfaced athletic facilities, including clay tennis courts and lawn bowling rinks.

The present invention includes an array of parallel, perforated pipes positioned below the surface of the athletic field which are connected at opposite ends thereof to a header pipe. In operation, water is periodically supplied to one of the header pipes which distributes the water throughout the entire array of pipes. Water in the array of pipes is allowed to escape through the perforations in the pipes and diffuse through the subsurface by capillary action to supply moisture to the surface of the athletic facility. The array of pipes also functions to drain and remove water from the array of pipes in instances, such as during or after rainstorms, when the surface of the athletic field becomes too wet.

A water control system is connected to one of the header pipes and is utilized to supply and drain water to and from each of the header pipes and the parallel array of pipes extending therebetween. The water control system of the present invention may be utilized with other existing systems and provides for a simple effecting means to supply and remove water from such system.

The water control system includes a reservoir which is connected to both a water supply source and a drain. An automatic timer controls the water supplied to the water control system. In this regard, the timer controls a control valve connected to the water supply source. The water level in the reservoir of the water control system is controlled by a float/valve device which overrides the timed control valve.

The water level in the water control system determines if water will be supplied or drained from the array of pipes. In this regard, as discussed in detail below, the relative difference between the heights of a drain pipe outlet and a water outlet pipe of the water control system, and the level of water in the reservoir determines if water will be supplied to or drained from the array of pipes.

Watering and draining between the water control system and the array of pipes is passively conducted at ambient conditions, i.e., ambient pressure. Therefore, it is not necessary to include a pump means between the water control system and the array of pipes.

The system of the present invention is particularly novel in that water is not pumped into the underground pipe system under pressure but is rather pumped into the water control box and thereafter allowed to flow under ambient pressure throughout the pipe network.

The system is designed to either supply water to or drain water from the uppermost surface area of the athletic facility above the pipes. This is accomplished in part by positioning the parallel pipes a suitable distance apart, e.g., 5–9 feet, in trenches which are filled in by a suitable material through which water may pass by capillary action, such as compacted soil. The surface of the athletic facility such as the clay surface of a tennis court can be properly moistened by supplying water to the water control system and removing water therefrom. As water enters the water control system, it flows out to one of the header pipes and onto and through each of the parallelly aligned pipes. Water exits through the perforations in the pipes and seeps upwardly through the soil to reach the upper surface of the athletic facility.

The necessary flow required for supplying water and drainage of water through the pipe network necessarily requires that the pipes each be substantially level particularly with respect to one another. In installing the pipe network, it has been found particularly advantageous to use laser leveling means. Other suitable leveling means which may be employed include liquid level tubes and similar devices.

Since the present system only requires a relatively narrow trench for each parallel pipe, the system may be easily installed into existing athletic fields without causing extensive damage to the athletic facility. Only parallel, spaced apart, narrow trenches need to be dug in the surface of the athletic facility to install the present system.

Surface water such as standing water from rain showers is effectively removed from the athletic facility by allowing the water to pass through the subsurface and enter the perforated pipes and flow therethrough out to the water control system whereat the excess water is removed by the drain in the water control system.

The present invention will now be described with reference to FIG. 1 which illustrates the array of pipes, including the arrangement of the plurality of parallel pipes, the header pipes and water distribution means in accordance with one embodiment of the present invention. In FIG. 1, a plurality of parallel, spaced apart, perforated pipes 1 are connected at opposite ends thereof to a header pipe 2. The array of pipes including the parallel and header pipes are positioned beneath the surface of an athletic facility such as a tennis court having an outer border indicated generally at 3. A water control system, discussed in detail below is indicated at 4. A water outlet pipe 5 connects the water control system to the array of pipes.

The parallel perforated pipes should be evenly spaced apart sufficiently so as to water and drain the entire area of the playing field. It has been determined that pipes positioned about 5–9 feet apart generally provide sufficient coverage for most fields. However, it should be obvious that the pipes may be positioned closer together, even though positioning the pipes closer together would require additional pipes, more expense and would necessarily require more excavating of the surface of an existing tennis court, or the like. In one embodiment, a total of 8 parallel pipes were in cooperated lengthwise under a standard 60′×120′ tennis court, wherein the pipes were spaced about 8.6 feet apart.

The outside diameter of the parallel perforated pipes should be between about 2 and about 6 inches. In a preferred embodiment, the parallel perforated pipes used had a outside diameter of about 4 inches. The header pipes could have an outside diameter between about 2 inches and about 6 inches. In a preferred embodiment, header pipes having a outside diameter of about 4 inches was found to be particularly useful.

Suitable perforations in the parallel pipes may include small through-holes or slits of any shape or combination of shapes. In a preferred embodiment the perforations included through-holes in the pipes having a diameter of about 0.5 inches and spaced about 4 inches apart. Suitable arrangements and sizes of the perforations are considered as being easily determined based on desired period of time in which to water or drain the athletic facility.

Figure 2:
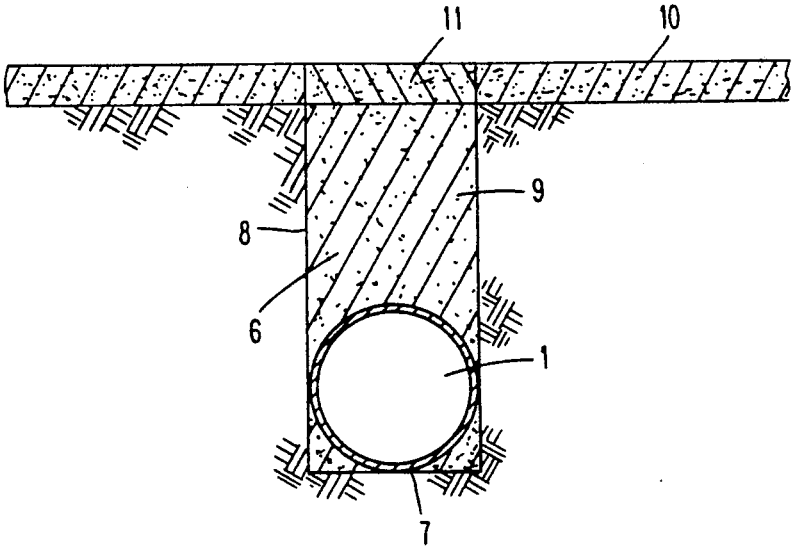
FIG. 2 is a partial schematic cross-sectional view illustrating the positioning of a water supply/drain pipe according to a preferred embodiment of the present invention.

FIG. 2 schematically illustrates an end view of one trench in which a perforated pipe 1 is positioned. As illustrated in FIG. 2, the perforated pipe rests on the bottom 7 of trench 6. The sides 8 of the trench 6 form a rectangular cavity which is completely blocked, at its bottom portion by pipe 1. Compacted soil 9, or a similar water porous material, is placed on top of the pipe and fills the trench up to a level even with the subsurface, below the surface layer 10. On top of the compacted soil a fresh surface layer 11 such as a clay surfacing material is added to match the surrounding surface of the athletic field. The compacted soil 9 or similar material may be conditioned as necessary with other filling material such as small gravel or sand, or the like, to provide desired capillary action as well as the additional benefit of drainage. The existing clay court surface 10 is left undisturbed.

It is essential that the perforated pipes 1 rest on a level bottom trench and are level with respect to one another. In this regard, it has been found particularly advantageous to check the level of the bottom of the trenches by means of a laser leveling device, or level tube, or similar device before installing the pipes. The depth of the trenches should be sufficient so that the upper surfaces of the parallel pipes are about 4 inches below the surface. Similar trenches and filling materials are utilized with the header pipes.

Because the present invention utilizes the perforated pipes to both water and drain the athletic field, and because the present invention supplies and removes water under atmospheric pressures, it is necessary for the system to have all of the perforated parallel pipes substantially level to one another.

Figure 3:
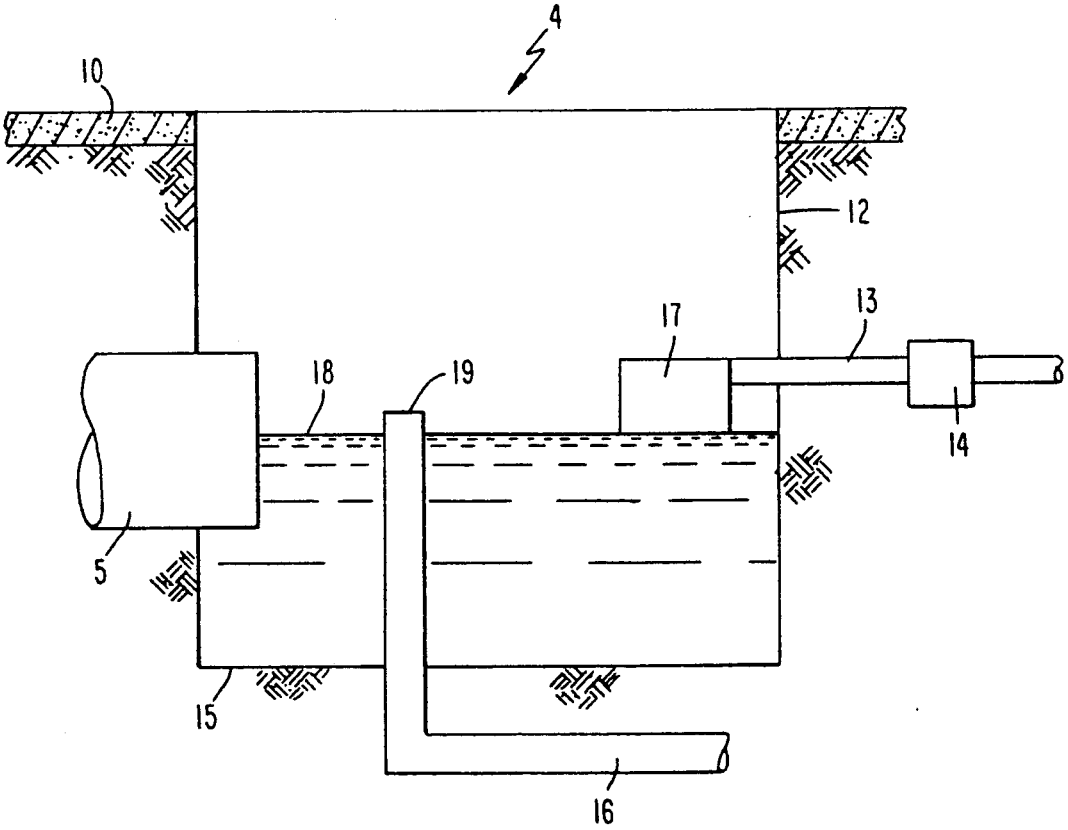
FIG. 3 is a schematic cross-sectional illustration of the water control system according to a preferred embodiment of the present invention.

FIG. 3 is a schematic side view of the water control system 4. The water control system comprises a waterproof reservoir 12 which is submerged below surface level 10, as illustrated in FIG. 3. The reservoir may be made of any suitable, waterproof material which will not appreciable deteriorate over time. Preferably, the reservoir is made from cement or otherwise a thick gauge plastic, fiberglass or a metal material.

The water control system includes an opening therein through which outlet pipe 5 is in fluid communication with the interior of the reservoir. The other end of pipe 5, as best illustrated in FIG. 1, is connected with one of the header pipes 2. In this regard, it is noted that in FIG. 1 the water control system is illustrated as being in the lower right hand corner of FIG. 1. However, the water control system may be in and convenient location as long as it connects to one of the pipes in the array, and preferably to one of the header pipes.

The water control system further includes an opening through which a water supply pipe 13 is in fluid communication with the interior of reservoir 12. The water supply pipe 13 is connected at one end thereof to the water control system 4 and at another end thereof to a suitable source of water (not shown), a main water supply pipe, a well or reservoir. Water is supplied to water supply pipe 13 by means of a control timer valve device 14.

Figure 4:
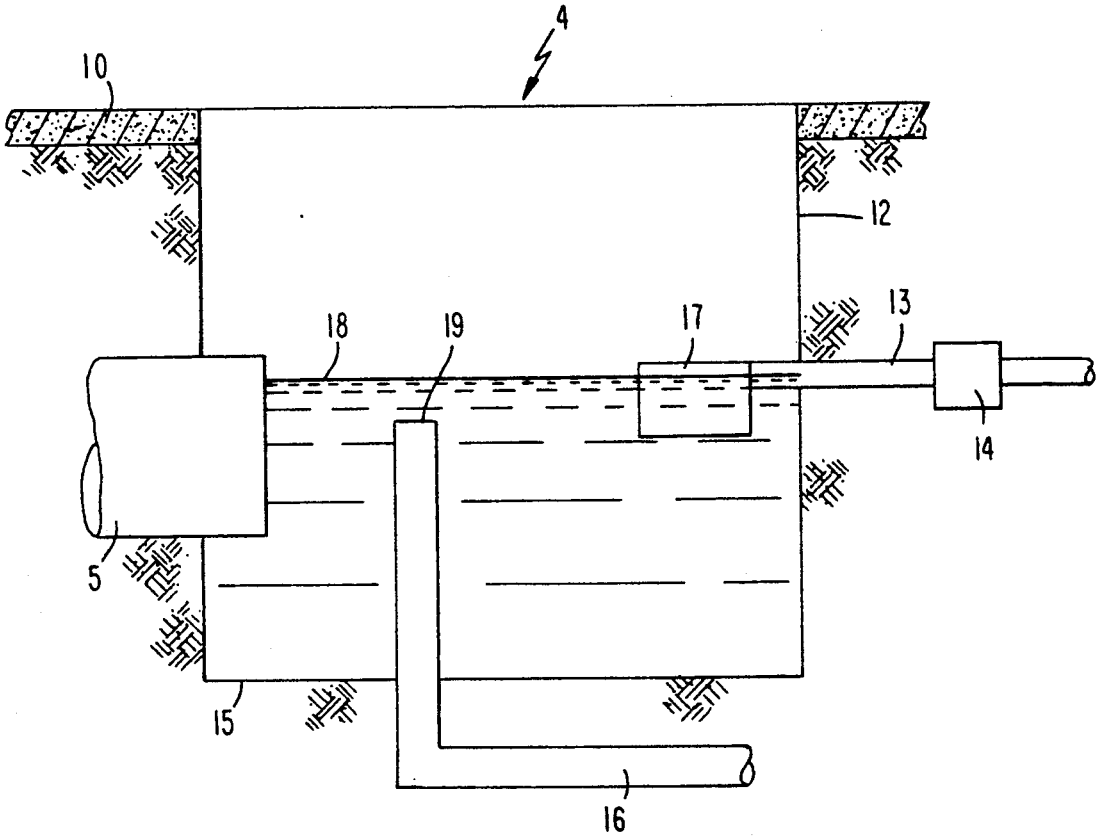
FIG. 4 is a schematic cross-sectional illustration of the water control system of FIG. 3 illustrating the height of the water level when the system is utilized to drain water from the overall system.

In the bottom 15 of the water control system is an inlet opening through which drain pipe 16 connects with the water control system and is in fluid communication with reservoir 12. Drain pipe 16 comprises a drain pipe which extends vertically up to a height in the reservoir which is below the upper most height of the water outlet pipe 5 as illustrated in FIGS. 3 and 4. For reasons discussed in detail below, the water drain pipe 16 extends upwardly to a height which is below the upper surface of the water outlet pipe 5 but above the height of the central axis of the water supply pipe as illustrated.

The water control system further includes a water control device 17 which includes a float connected to and controlled by a valve member which closes off water supply pipe 13 when the water within the water control box reaches a proper height as determined by the float.

FIG. 3 illustrates the operation of the water control system as water is being supplied to the overall system, including the array of pipes. As seen in FIG. 3, water level 18 is controlled by a water level control device 17 so that the level of the water is below the open outlet end 19 of the drain pipe 16. At this illustrated water level, the water level is sufficiently high so that water enters water inlet pipe 5, but is, at the same time, below outlet 19 of the water drain pipe 16. Thus, during watering, the water level is maintained at a height at which the water is able to enter the array of pipes, but is not allowed to drain from the water control system.

FIG. 4 illustrates the operation of the water control system open the water control system is used to drain water from the array of pipes. In FIG. 4, water flows from the array of pipes through the outlet pipe 5 into the water control system reservoir 12. As the water flows into the water control system reservoir, the height 18 of the water level is above, outlet opening 19 of drain pipe 16 as illustrated., Thus, water is allowed to drain from the array of pipes into the water control system reservoir and out of the water control system through drain pipe 16 until such time as the water drainage slows down and water level 18 drops below the outlet opening 19 of drain pipe 16.

In order to automate and prevent excess moisture in the system during rain storms, a rain cut off switch operably connected to two solenoids, one on the water supply pipe and one on a lower portion of the drain pipe, may be included which close the water supply pipe and open a lower portion of the drain pipe. Additionally, moisture level sensor positioned to measure the moisture in the upper 2–3 inches of the playing surface could be incorporated and used to control the solenoid on the water inlet pipe.

The system may further include a number of vent pipes 20 located in one or more corners of the array of pipes, preferably opposite to the water control system 4. Such vent pipes could extend 12" above the surface and have caps openable to vent the array of pipes as necessary to drain the system. Optionally a vacuum pump 21 could be connected to the water control system to evacuate water under conditions of extreme rain. Use of such vacuum pump would require closing the vent caps and ensuring that the water control system was substantially fluid tight.

In normal operation, when the system is utilized for irrigation, intermittent waterings are preferably utilized. For example, dependent on ambient conditions, solenoid or timer 14 may operate to open water supply pipe 13 for every 2 to 8 hours for a period of time sufficient to fill the irrigation system and attain a steady height of water in the water control box, e.g., 0.5–1 hour. In one example in which the system was utilized, the solenoid or timer 14 operated to open the water supply pipe 13 every two hours for 30 minutes each.

The parallel pipes allow water to flow freely into or out of the subsurface zone that is directly below the athletic field, e.g., tennis court playing surface. Water is periodically allowed to flow into the array of pipes. If moisture in the subsurface zone is adequate, then a very small amount of water will be absorbed and the water level control device 17 will prevent water from being supplied to the water control system reservoir 12. If the subsurface zone requires additional water it will absorb as much water as needed during the watering cycle. During the watering cycle, water in the array of pipes is added from the water control system reservoir as needed.

When the watering cycle ends, no additional water is supplied to the array of pipes until the next watering cycle and only water remaining in the array of pipes and water control system reservoir will be available for absorption into the subsurface zone to maintain optimum moisture. Each watering cycle is followed by a use cycle during which the athletic facility looses water by evaporation. If very little evaporation occurs, the subsurface zone will remain basically unchanged. Irrigation by the present invention has been found to be even, uniform and capable of maintaining constant moisture while avoiding the type of surface erosion associated with surface sprinkling methods.

One advantage of the present invention over the prior art was that water left in the array of pipes is conserved within the system. It has also been found that the present system allows use of clay tennis courts, and the like, while they are being irrigated.

The present invention requires excavation of an area of only 4 percent of a standard tennis court surface area when utilizing 8 parallel pipes having a outside diameter of 4 inches. Thus, the present invention may be easily installed into existing courts without major destruction of the playing surface.

Although the invention has been described with reference to particular means, materials and embodiments, from the foregoing description, one skilled in the art can easily ascertain the essential characteristics of the present invention and various changes and modifications may be made to adopt the various uses and conditions thereof without departing from the spirit and scope of the present invention as described by the claims that follow.

We claim:

1. An underground system for supplying and removing moisture to and from a surface of a hard, natural surfaced tennis court which surface comprises a material which is susceptible to excessive moisture and dryness comprising:

a pair of rectangularly cross sectional trenches having substantially level bottoms, and pair of trenches being parallel to one another;

a plurality of rectangularly cross sectioned trenches having substantially level bottoms, said trenches being relatively equally spaced apart from and aligned parallel to one another and extending at opposite ends thereof between said pair of trenches;

a pipe located within and on said bottoms of each of said trenches for supplying moisture to and removing moisture from said trenches, wherein each of said pipes are horizontally coplanar with respect to one another;

a sublayer of material through which moisture may pass by capillary action located in said each of said trenches, above said means for supplying and removing moisture;

a surface layer of said material which is susceptible to excessive moisture and dryness located on said sublayer; and a water control system for supplying and removing, under ambient pressures, water to and from said means for supplying and removing moisture.

2. An underground system for supplying and removing moisture to and from a surface of a hard, natural surfaced tennis court according to claim 1, wherein said pipes comprise perforated pipes, and the cross sectional width of each of said trenches is substantially equal to the outside diameter of said respective pipe located therein.

3. An underground system for supplying and removing moisture to and from a surface of a hard, natural surfaced tennis court according to claim 1, wherein said sublayer comprises compacted earth.

4. An underground system for supplying and removing moisture to and from a surface to a hard, natural surfaced tennis court according to claim 1, wherein said water control system further comprises a control device which maintains the level of water in said reservoir at a predetermined height when said apparatus is being utilized to supply moisture to the athletic facility.

5. An underground system for supplying and removing moisture to and from a surface of a hard, natural surfaced tennis court according to claim 4, wherein said water supply system further comprises a timer to control fluid communication to said water supply pipe.

6. A method for installing an underground system for supplying and removing moisture to and from a surface of a hard, natural surfaced tennis court which comprises:

digging a pair of rectangularly cross sectioned trenches having substantially level bottoms in said surface of said hard, natural surfaced tennis court, said pair of trenches being parallel to one another;

digging a plurality of rectangularly cross sectional trenches having substantially level bottoms in said surface of said hard, natural surfaced tennis court, and trenches being relatively equally spaced apart from and aligned parallel to one another and extending at opposite ends thereof between said pair of trenches;

positioning a pipe on said bottoms of each of said trenches for supplying and removing moisture to and from said trenches, wherein all of said pipes are horizontally coplanar with respect to one another;

filling in said trenches with a sublayer of a material through which moisture may pass by capillary action above said means for supplying and removing moisture;

covering each of said trenches with a surface layer of said material which is susceptible to excessive moisture and dryness; and connecting said pipes to a water control system for supplying and removing, under ambient pressures, water from said pipes.

7. A method for installing an underground system for supplying and removing moisture to and from a surface of a hard, natural surfaced tennis court according to claim 6, wherein said bottoms of each of said trenches is essentially leveled prior to positioning said pipes therein.

8. A method for installing an underground system for supplying and removing moisture to and from a surface of a hard, natural surfaced tennis court according to claim 6, wherein the cross sectional width of each of said parallel trenches is about 4 inches.

9. A method for installing an underground system for supplying and removing moisture to and from a surface of a hard, natural surfaced tennis court according to claim 6, wherein said pipes comprise perforated pipes and the cross sectional width of each of said trenches is substantially equal to the outside diameter or said respective pipe located therein.

10. A method for installing an underground system for supplying and removing moisture to and from a surface of a hard, natural surfaced tennis court according to claim 8, wherein said sublayer comprises compacted earth.

11. A method for installing an underground system for supplying and removing moisture to and from a surface of a hard, natural surfaced tennis court according to claim 6, wherein said water control system further comprises a control device which maintains the level of water in said reservoir at a predetermined height when said apparatus is being utilized to supply moisture to the hard, natural surfaced tennis court.

12. A method for installing an underground system for supplying and removing moisture to and from a surface of a hard, natural surfaced tennis court according to claim 11, wherein said water supply system further comprises a timer to control fluid communication to said water supply pipe.

13. An underground system for supplying and removing moisture to and from a surface of a hard, natural surfaced tennis court which surface comprises a material which is susceptible to excessive moisture and dryness comprising:

a pair of rectangularly cross sectioned trenches having substantially level bottoms, said pair of trenches being parallel to one another;

a plurality of rectangularly cross sectioned trenches having substantially level bottoms, said trenches being relatively equally spaced apart from and aligned parallel to one another and extending at opposite ends thereof between said pair of trenches;

a pipe located within and on said bottoms of each of said trenches for supplying moisture to and removing moisture from said trenches, wherein each of said pipes are horizontally coplanar with respect to one another;

a sublayer of material through which moisture may pass by capillary action located in said each of said trenches, above said means for supplying and removing moisture;

a surface layer of said material which is susceptible to excessive moisture and dryness located on said sublayer; and a water control system for supplying and removing, under ambient pressures, water to and from said means for supplying and removing moisture, said water control system being positioned below ground level and comprising a reservoir including a water supply pipe, a water outlet pipe which is in fluid communication with one of said pairs of trenches, and a drain pipe, said water outlet pipe extending horizontally into said reservoir and said drain pipe including an outlet opening which is positioned within said reservoir below the upper most portion of said water outlet pipe and above the horizontal axis of said water outlet pipe.

14. A method for installing an underground system for supplying and removing moisture to and from a surface of a hard, natural surfaced tennis court which comprises:

digging a pair of rectangularly cross sectioned trenches having substantially level bottoms in said surface of said hard, natural surfaced tennis court, said pair of trenches being parallel to one another;

digging a plurality of rectangularly cross sectioned trenches having substantially level bottoms in said surface of said hard, natural surfaced tennis court, said trenches being relatively equally spaced apart from and aligned parallel to one another and extending at opposite ends thereof between said pair of trenches;

positioning a pipe on said bottoms of each of said trenches for supplying and removing moisture to and from said trenches, wherein all of said pipes are horizontally coplanar with respect to one another;

filling in said trenches with a sublayer of a material through which moisture may pass by capillary action above said means for supplying and removing moisture;

covering each of said trenches with a surface layer of said material which is susceptible to excessive moisture and dryness; and connecting said pipes to a water control system for supplying and removing, under ambient pressure, water from said pipes, said water control system being positioned below ground level and comprising a reservoir including a water supply pipe, a water outlet pipe which is in fluid communication with one of said pairs of trenches, and a drain pipe, said water outlet pipe extending horizontally into said reservoir and said drain pipe including an outlet opening which is positioned within said reservoir below the upper most portion of said water outlet pipe and above the horizontal axis of said water outlet pipe.

15. In an underground system for supplying water to and removing water from a hard, natural surfaced tennis court by means of an arrangement of distribution pipes positioned underground, the improvement comprising insuring that all the pipes in the system are horizontally coplanar with respect to one another and providing a water control system for supplying and removing, under ambient pressures, water from said arrangement of distribution pipes, said water control system being positioned below ground level and comprising a reservoir including a water supply pipe, a water outlet pipe which is in fluid communication with said arrangement of distribution pipes, and a drain pipe, said water outlet pipe extending horizontally into said reservoir and said drain pipe including an outlet opening which is positioned within said reservoir below the upper most portion of said water outlet pipe and above the horizontal axis of said water outlet pipe.

* * * * *